US005317893A

United States Patent [19]

Eigenmann et al.

[11] Patent Number: 5,317,893

[45] Date of Patent: Jun. 7, 1994

[54] SINGLE SHAFT PUNCH PRESS

[75] Inventors: Oskar Eigenmann; Helmut Messner, both of Arbon, Switzerland

[73] Assignee: Bruderer AG, Frasnacht, Switzerland

[21] Appl. No.: 964,430

[22] Filed: Oct. 21, 1992

[30] Foreign Application Priority Data

Dec. 11, 1991 [CH] Switzerland ..... 3649/91-6

[51] Int. Cl.[5] ..... B30B 5/00; B21J 7/42

[52] U.S. Cl. ..... 72/450; 83/615; 83/632; 100/257; 100/282

[58] Field of Search ..... 72/450, 451; 83/615, 83/632; 100/257, 282, 283, 284

[56] References Cited

U.S. PATENT DOCUMENTS 2,364,661 12/1944 Rode et al. .
2,738,748 3/1956 Hecht ..... 72/450
4,156,387 5/1979 Portmann ..... 83/615
4,318,295 3/1982 Sindelar ..... 100/282
4,757,734 7/1988 Portmann ..... 83/632
5,052,257 10/1991 Eigenmann ..... 83/632

FOREIGN PATENT DOCUMENTS 0395964 11/1990 European Pat. Off. .
2283776 4/1976 France .
165900 6/1990 Japan ..... 100/257
382342 11/1932 United Kingdom .

*Primary Examiner*—David Jones
*Attorney, Agent, or Firm*—Ladas & Parry

[57] ABSTRACT

Four lever units are linked to the arrangement of connecting rods via a common bolt. Each lever unit drives one ram of the punch press. The rams are arranged in configuration of a square. This allows a much higher loading by off-center forces and the punch press can be designed for a given punch press output with considerably smaller dimensions.

5 Claims, 3 Drawing Sheets

SINGLE SHAFT PUNCH PRESS

BACKGROUND OF THE INVENTION

1. Field of the Invention

The present invention relates to a single shaft punch press, including a machine frame, an eccentric shaft supported for rotation in the machine frame, a tool carrier guided for a rectilinear reciprocating movement in the machine frame, an arrangement of connecting rods having a plurality of connecting rod members drivingly mounted on the eccentric shaft, a lever means having a plurality of lever units, every lever unit having a first end and a second, opposite end, at which first end every lever unit is pivotally mounted to connecting rod members of the arrangement of connecting rods and at which second end every lever unit is pivotally supported at the machine frame, and every lever unit having a pivot member intermediate its first and second ends forming a further pivotal point, an arrangement of rams having a plurality of rams each having a first and a second, opposite end, which rams are pivotally mounted at their first end to a respective pivot member forming a further pivotal point of a respective lever unit, and at their second end to the tool carrier.

2. Description of the Prior Art

The off-center loading of the tools and tool carriers at single shaft punch presses, specifically the loading of the upper tool in such punch presses, causes a variety of difficulties and drawbacks. In a given frame size or machine size, respectively, the allowable loading of the tools decreases considerably towards the edge areas of the tools and reaches in certain cases even the value zero. Off-center loadings of the tools in punch presses cause a high wear and an increased friction specifically at bearings, e.g. between rams and tool carrier and also between rams and driving linkage members pivotally mounted thereto. An increased wear occurs also at the guiding structures of the rams and of the tools and also in tools themselves. Furthermore, off-center loadings cause also cogging or canting, respectively, and also elastic deformations such as, for instance, a deflecting of elongated structural members of the punch press and accordingly inaccurate products are produced.

SUMMARY OF THE INVENTION

It is, therefore, a general object of the invention to provide a single shaft punch press which allows off-center loadings of the tools and tool carriers and yet the production of precise products.

A further object is to provide a single shaft punch press having lever means which include four single lever units arranged separate from each other, of which every single lever unit is pivotally mounted independently from any other lever unit to the connecting rod members of an arrangement of connecting rods and to the machine frame, and having an arrangement of rams including four parallel rams of which each is pivotally mounted at a first end thereof to one respective lever unit at a respective pivot member forming a further pivotal point at the respective lever units, and at its second, opposite end to the tool carrier, whereby the tool carrier of the single shaft punch press is suspended at four points by rams.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
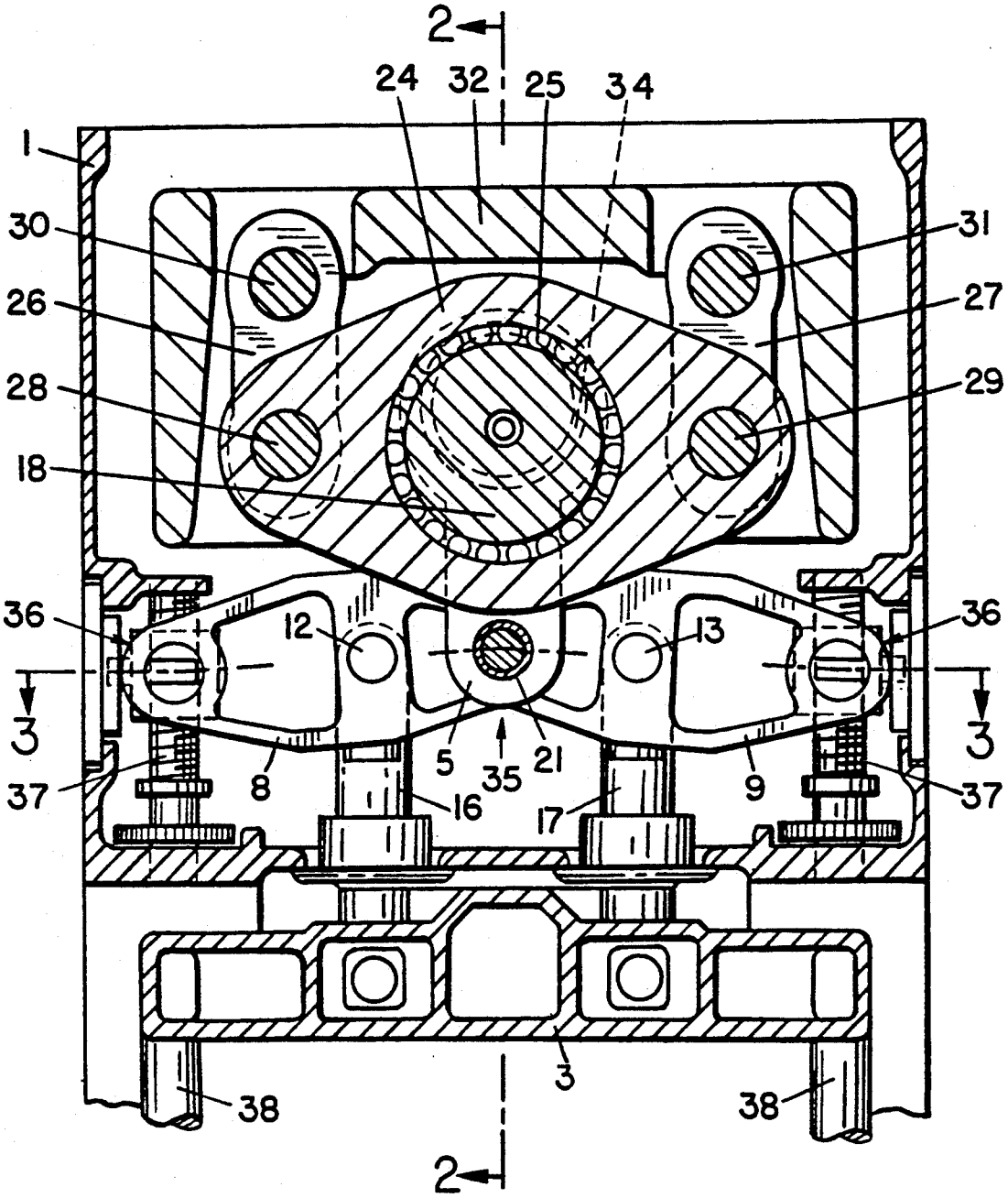
FIG. 1 is a vertical section through a single shaft punch press.

The single shaft punch press includes an eccentric shaft 2 supported for rotation via roller bearings 22 and 23 in the machine frame 1. The eccentric shaft 2 is coupled via a coupling/braking apparatus to a flywheel which in turn is drivingly connected via a belt drive to an electric motor. Mentioned structures are generally known and used in punch presses such that a detailed description thereof is not needed for the person skilled in the prevailing art.

The eccentric shaft 2 includes a center eccentric section 18 and at both sides of this center eccentric section 18 one respective further eccentric section 19 and 20, resp. (see FIG. 2). A yoke shaped mass balancing weight 24 is supported via roller bearings 25 on the center eccentric section 18. This mass balancing weight 24 balances the rotating mass forces occurring in operation of the punch press. Linkage rods 26 and 27, resp., are pivotally mounted by pivot pins 28 and 29, resp., to the two lateral ends of the mass balancing weight 24, which linkage rods 26 and 27 are in turn pivotally mounted via further pivot pins 30 and 31, resp., to the mass balancing weight 32 which in operation of the punch press balances the oscillating mass forces. Above mentioned structure and design is disclosed in detail in the U.S. Pat. No. 4,757,734 of the same applicant, which disclosure is incorporated herein by reference.

The further eccentric sections 19, 20 located at both sides of the center eccentric section 18 support connecting rod members 4 and 5, resp., mounted thereonto via roller bearings 33 and 34, resp. The lower end of the connecting rod members 4, 5, resp., is designed according to the embodiment of FIG. 2 in shape of a fork having three prongs. A bolt 21 projects through the walls of the connecting rod members 4, 5 formed by the prongs of the fork. FIG. 2A illustrates a further embodiment which will be described more in detail further below.

The four lever units 6, 6A and 7, 7A and 8, 8A and 9, 9A, resp., of the lever means of the punch press are pivotally mounted at one of their ends to this bolt 21. These ends are identified in the figures generally by the reference numeral 35.

At their second, opposite ends, which are generally identified by the reference numeral 36, the lever units are supported according to the illustrated embodiment via threaded spindles 37 on the machine frame 1. The adjustment of the height level of the ends 36 of these lever units and accordingly of the upper tool carrier 3 of the punch press proceeds by a rotating of these threaded spindles. The details of this design for the adjustment of the height level of the tool carrier are disclosed in the U.S. Pat. No. 5,052,257, which disclosure is incorporated herein by reference.

Attention is now specifically drawn to FIG. 3 based on which the lever means of the punch press will now be explained. Two single-arm lever units are allocated to each connecting rod member 4 and 5, resp., which lever units are supported at one of their ends on the bolt 21.

The lever units are structured due to design reasons as having two lever unit portions located adjacent to each other.

The lever unit consisting of the lever unit portions 8, 8A and the lever unit consisting of the lever portions 9, 9A are allocated to the correcting rod member 4. Accordingly, these two lever units are arranged in a pairwise fashion.

In other words, it can be stated that the lever units consisting of the lever unit portions 8, 8A and 9, 9A form a lever pair driven by the connecting rod member 4.

The lever unit consisting of the lever unit portions 6, 6A and the lever unit consisting of the lever unit portions 7, 7A are allocated to the connecting rod member 5. Also these lever units form a lever unit pair composed for design reasons of mentioned lever unit portions.

All individual lever unit portions 6, 6A, 7, 7A, 8, 8A, 9, 9A forming the entire lever means of the punch press are single arm levers which are supported at one end on a bolt 21 common to all and at the other, opposite end at the threaded spindle 37 and thus indirectly on the machine frame 1.

Figure 2:
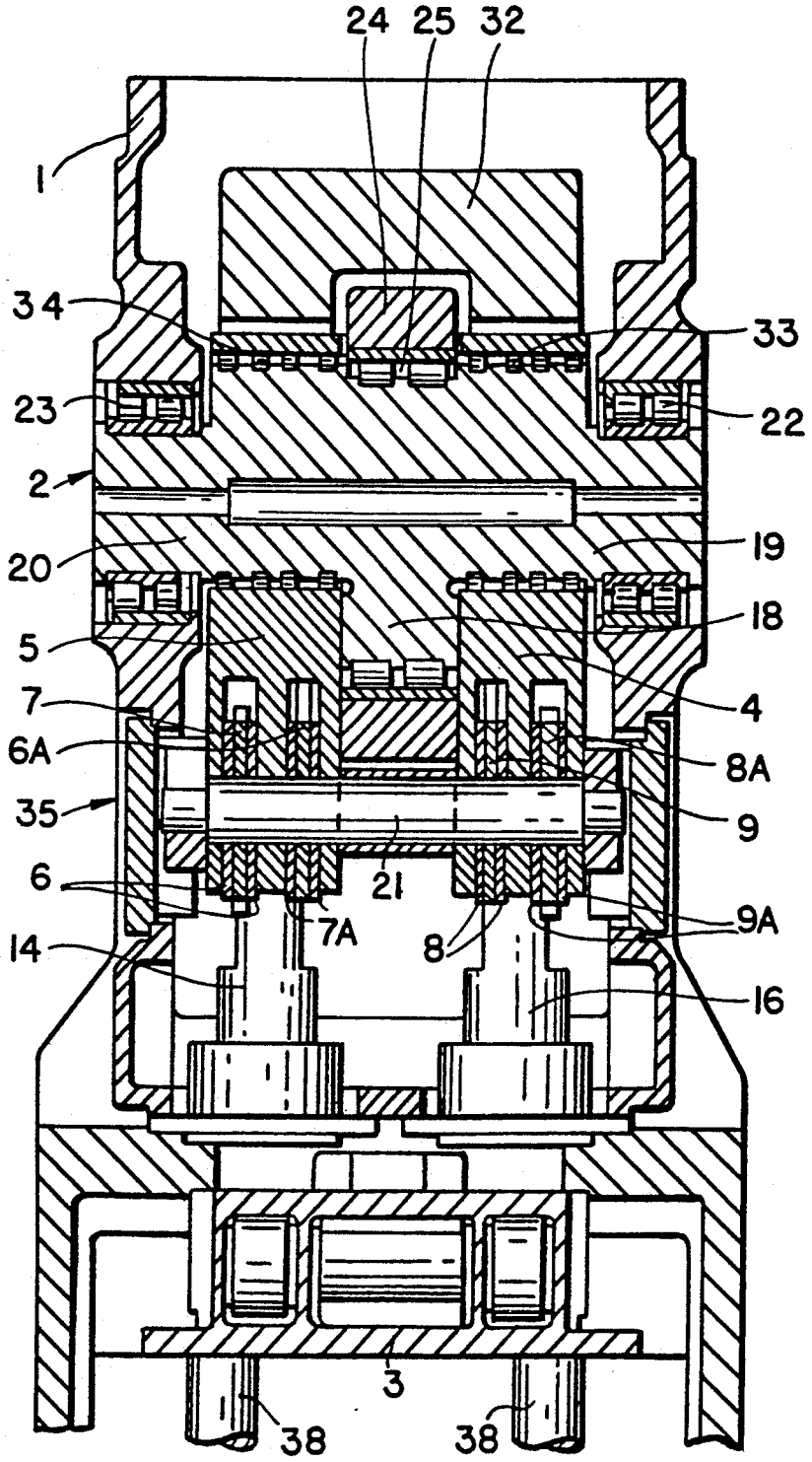
FIG. 2 illustrates a section along line II—II of FIG. 1.
Figure 3:
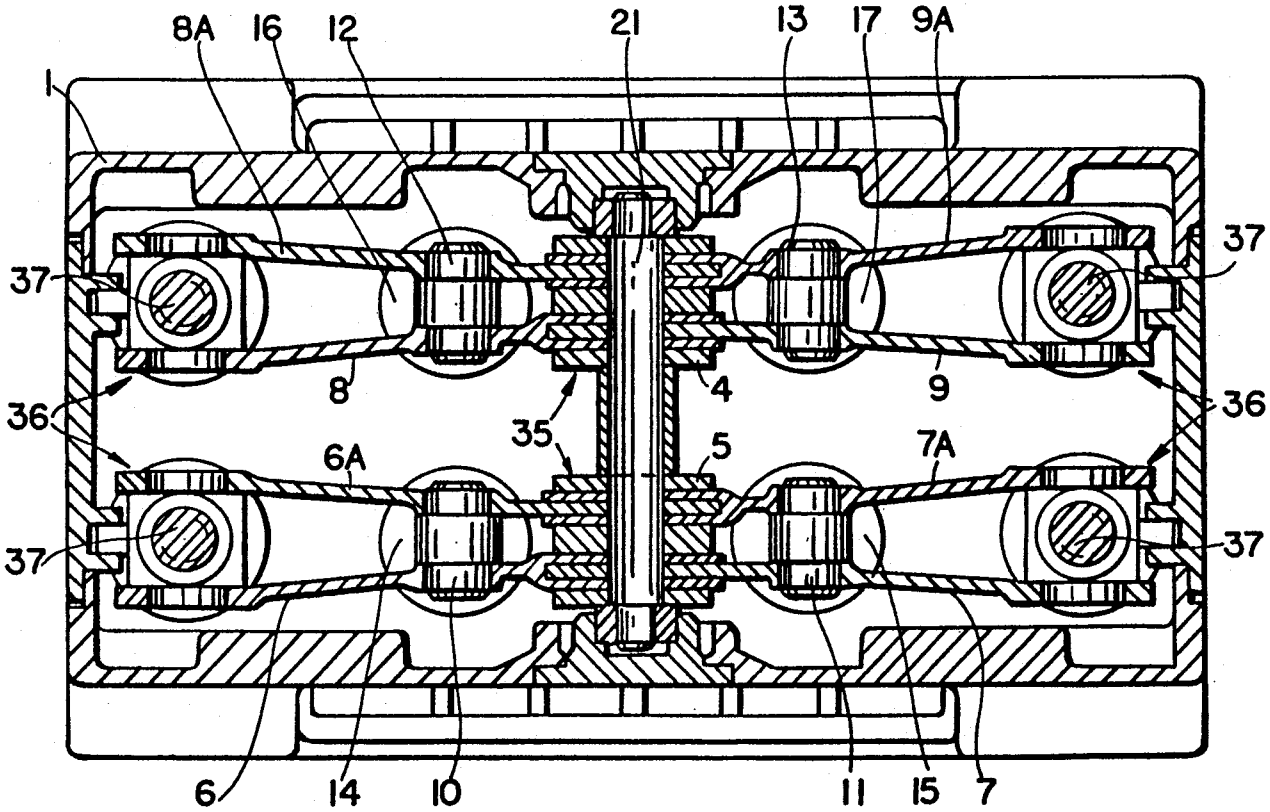
FIG. 3 illustrates a section along line III—III of FIG. 1.
Figure 2A:
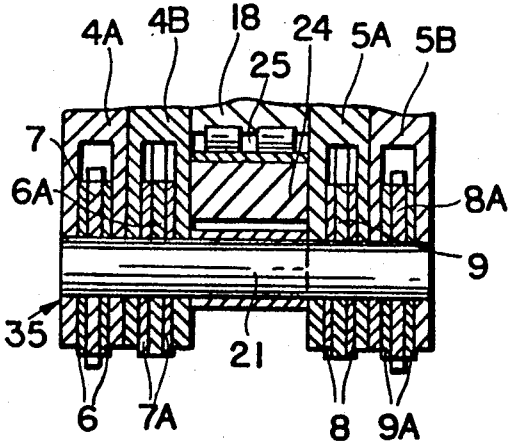
FIG. 2A illustrates a further embodiment of the design of the rams.

As can be seen clearly in FIG. 3 and also in FIG. 2, these lever units penetrate into each other at their ends at the bolt 21 in a forklike manner. The lever unit portion 9A includes a forked end, and the lever portion 8A projects into the interstice present between the prongs of the fork. The lever unit portion 8 is forked and receives between its prongs the lever unit portion 9. Furthermore, the lever unit portions 7A and 6 are of a forked design and receive between the prongs of the forks the lever unit portions 6A and 7, resp.

Each lever unit mounts at a location between its two ends 35, 36 a pivot pin 10, 11, 12 and 13, resp., each pivot pin determines accordingly a further pivot point.

The lever unit consisting of the lever unit portions 6, 6A includes the pivot pin 10, the lever unit consisting of the lever unit portions 8, 8A includes the pivot pin 11, the lever unit consisting of the lever unit portions 7, 7A includes the pivot pin 12 and the lever unit consisting of the lever unit portions 9, 9A includes the pivot pin 13.

The ram 14 is linked at the pivot pin 10, the ram 15 is linked at the pivot pin 11, the ram 16 is linked at the pivot pin 12 and the ram 17 is linked at the pivot pin 13. Accordingly, this single shaft punch press comprises four rams. At their lower, opposite end these rams 14, 15, 16 and 17 are pivotally mounted to the tool carrier 3. The tool carrier 3 cooperates in a generally known manner with four guiding columns 38, via which the tool carrier 3 is guided at the machine frame 1.

FIG. 2A illustrates a further embodiment, in which both connecting rod members 4, 5 are separated in such a manner that totally four single connecting rods 4A, 4B and 5A, 5B are present. Accordingly, each ram is allocated to one pair of levers, referring to FIG. 3 the connecting rod 4A is allocated to the lever unit portions 6 and 7.

It is now evident from the above detailed description that the four rams 14, 15, 16, 17 determine the corners of a rectangular square. Accordingly, off-center loadings can be absorbed in the punch press without suffering the initially explained drawbacks. Furthermore, because the transmitting of the forces occurring in operation via the various structural members of the punch press up to the eccentric shaft 2 or connecting rod members 4, 5, resp., occurs via four paths completely independent from each other, it is possible to design now this punch press for a given size of the press, which is determined by the force to be exerted by the tool with considerably smaller dimensions.

While there are shown and described present preferred embodiments of the invention, it is to be distinctly understood that the invention is not limited thereto, but may be otherwise variously embodied and practiced within the scope of the following claims.

We claim:

1. A single shaft punch press, including a machine frame, an eccentric shaft supported for rotation in said machine frame, a tool carrier guided for a rectilinear reciprocating movement in said machine frame, an arrangement of connecting rods having a plurality of connecting rod members drivingly mounted on said eccentric shaft, a lever means having a plurality of lever units, every lever unit having a first end and a second, opposite end, at which first end every lever unit is pivotally mounted to connecting rod members of said arrangement of connecting rods and at which second end every lever unit is pivotally supported at said machine frame, and every lever unit having a pivot member intermediate its first and second ends forming a further pivotal point, an arrangement of rams having a plurality of rams each having a first and a second, opposite end, which rams are pivotally mounted at their first end to a respective lever unit, and at their second end to said tool carrier;

said lever means comprising four single lever units arranged separate from each other, of which every single lever unit is pivotally mounted independently from any other lever unit to the connecting rod members of said arrangement of connecting rods and to the machine frame, and said arrangement of rams comprising four parallel rams of which each is pivotally mounted at its first end to one respective lever unit at a respective pivot member forming a further pivotal point, and at its second, opposite end to said tool carrier, whereby said tool carrier of said single shaft punch press is suspended at four points by rams.

2. The single shaft punch press of claim 1, in which said eccentric shaft comprises a center eccentric portion and at both sides of the center eccentric portion one further eccentric portion, the punch press comprises further a means for balancing mass forces occurring during the operation of the press, which balancing means is mounted to and driven by said center eccentric portion, said connecting rod members of said arrangement of connecting rods are respectively supported on one of said further eccentric portions of the eccentric shaft, said lever units of said lever means are designed and arranged as single arm lever pairs having said first and said second, opposite ends, which single arm lever pairs are pivotally mounted at their first ends via a bolt common to all to a respective connecting rod and at their second ends to the machine frame, and the respective pivot members each forming a further pivotal point are located intermediate of said first and second ends, said rams are pivotally mounted at their respective first ends to respective pivot members at the respective further pivotal points of said single arm lever pairs, and at their respective second ends to the machine frame, such that each connecting rod member is mounted simultaneously to two single arm lever pairs of which each is in turn mounted to one of said rams.

3. The single shaft punch press of claim 2, in which respective two single arm lever units of said lever pairs are arranged adjacent each other and said pivot members forming further pivotal points are located at a same distance from said one bolt common to all single arm lever pairs, such that said rams determine the corners of a rectangular square.

4. The single shaft punch press of claim 2, in which each connecting rod member has the shape of a fork with three prongs and each lever unit consists of two adjacent lever unit portions having a first and a second end, which lever unit portions are supported at their first ends on said bolt common to all in the respective interstices present between the side walls of the prongs.

5. The single shaft punch press of claim 2, in which each connecting rod member consists of two adjacent connecting rod portions each having a forked head with two prongs and each lever unit consists of two adjacent lever unit portions having a first and a second end, which lever unit portions are supported at their first ends on said bolt common to all in the respective interstices present between the side walls of the prongs, such that the arrangement of connecting rods includes four connecting rods.

* * * * *